United States Patent [19]

Das et al.

[11] Patent Number: 4,470,853

[45] Date of Patent: Sep. 11, 1984

[54] COATING COMPOSITIONS AND METHOD FOR THE TREATMENT OF METAL SURFACES

[75] Inventors: Narayan Das, Westmont; Peter M. Stastny, Elk Grove Village, both of Ill.

[73] Assignee: Coral Chemical Company, Waukegan, Ill.

[21] Appl. No.: 538,585

[22] Filed: Oct. 3, 1983

[51] Int. Cl.[3] ..... C23F 7/00

[52] U.S. Cl. ..... 148/6.15 Z; 148/6.27

[58] Field of Search ..... 148/6.15 Z, 6.27, 6.15 R

[56] References Cited

U.S. PATENT DOCUMENTS

| | | | |
|---|---|---|---|
| 3,682,713 | 8/1972 | Ries | 148/6.14 R |
| 3,964,936 | 6/1976 | Das | 148/6.27 |
| 4,054,466 | 10/1977 | King et al. | 148/6.27 |
| 4,071,334 | 4/1977 | Matsushing | 148/6.27 |
| 4,111,722 | 9/1978 | Reghi et al. | 148/6.15 R |
| 4,273,592 | 6/1981 | Kelly | 148/6.27 |
| 4,277,292 | 7/1981 | Tupper | 148/6.14 R |
| 4,313,769 | 2/1982 | Frelin et al. | 148/6.27 |
| 4,391,562 | 7/1983 | Das | 148/6.27 |

FOREIGN PATENT DOCUMENTS

| | | | |
|---|---|---|---|
| 2444692 | 3/1975 | Fed. Rep. of Germany | 148/6.15 R |

*Primary Examiner*—Sam Silverberg

*Attorney, Agent, or Firm*—Fitch, Even, Tabin & Flannery

[57] ABSTRACT

An aqeuous acidic composition provides improved coating for aluminum. The composition comprises from about 10 to about 150 ppm zirconium, from about 20 to about 250 ppm fluoride, from about 30 to about 125 ppm tannin, from about 15 to about 100 ppm phosphate and from about 5 to about 50 ppm zinc, said coating solution having a tannin to phosphate ratio in the range of at least about 1:1 to about 2:1 and a pH in the range of about 2.3 to about 2.95.

15 Claims, No Drawings

COATING COMPOSITIONS AND METHOD FOR THE TREATMENT OF METAL SURFACES

The present invention relates to the treating of aluminum surfaces to improve certain properties thereof. More particularly, this invention relates to the chemical treatment and coating of aluminum surfaces to produce coatings or conversion coatings which improve the corrosion resistance of the aluminum and the adhesion characteristics for paints, inks, lacquers and other over-coatings which are applied to the treated aluminum surface.

Environmental concern and regulations have curtailed the level of discharge of environmentally objectionable compounds to waste systems. This has occasioned the restriction of use of conventional chromium containing treating chemicals in the metal treatment and coating industry and necessitated the use of materials which do not contain chromium.

U.S. Pat. No. 4,017,334 to Matsushima et al. describes a process for coating aluminum wherein the surface is contacted with a treatment bath containing phosphate, a tannin, titanium and fluoride prior to inking and lacquering. The pH of Matsushima's aqueous treating bath is preferably between 3 and 4. The treatment bath does not include chromium.

U.S. Pat. No. 4,148,670 to Kelly describes a coating and treatment bath which contains zirconium or titanium, fluoride and phosphate. The coating deposited on the metal surface, however, provides poor adherence to water-borne over-coatings. Further, Kelly does not describe a treatment bath which uses tannin or zinc.

U.S. Pat. No. 4,338,140 to Reghi describes a coating solution or treatment bath containing zirconium, fluoride, tannin, and phosphate. With respect to baths for the disposition of a coating containing zirconium and zirconium oxide, the coating is at a temperatures of 100° F. or above with the treatment bath having a pH of at least 3 to obtain the desired coating.

In the treatment of aluminum surfaces, and particularly the surfaces of aluminum beverage containers, it is important to provide the surface of the container with a protective corrosion resistant coating which is clear and colorless and retains the brightness of the surface. Further, the protective coating should not impair the taste characteristics of a food or beverage in the container. Additionally, frequently after coating an aluminum container, the exterior of the container is decorated. As a result, it is also important that the coating provide good adhesion characteristics with over-coated decorations and finishes, such as paint and lacquer. Hence, the adhesion characteristics of the coating with over-coatings as well as the ability to retain the brightness of the surface of the can, particularly where there is no paint or decoration, is important.

Additional considerations of importance for the treatment bath which is applied to the aluminum and which provides the coating are: (1) The energy utilized by the method of application of the conversion coating, including the temperature at which the coating is applied; (2) the quality of the resulting coating; and (3) the control necessary to achieve the desired coating, a high quality coating with short application times and relatively low process temperatures being desired.

The coatings must maintain the protective and adhesive characteristics and not discolor or distort even when subjected to subsequent treating conditions. Frequently, the containers are filled and closed, and then subjected to further treatment. For example, beverages such as beer are put into cans with the cans being sealed and subjected to temperatures in the range from about 150° F. to about 160° F. in water for a period of about 30 minutes to pasteurize the beer in the cans.

A quality control method is known to test coated aluminum surfaces which may be subjected to pasteurization conditions, the test being known as the Reynolds TR-4 Corrosion Resistance Test. The coated aluminum surface also may be subjected to a muffle furnace test wherein the surface is cleaned and treated, and then is exposed in a muffle furnace having a temperature in the range of between about 900° F. to about 1000° F. for 4 or 5 minutes. In the muffle furnace test, the presence of a satisfactory coating is indicated by a light yellow to golden discoloration on the aluminum surface depending on the amount of coating deposited thereon. Further, to test adhesion qualities with over-coatings, the coated aluminum surface may be subjected to a tape adhesion test.

Coatings which produce satisfactory results with respect to corrosion, adhesion and color must do so within permissible treatment times which, under current manufacturing conditions, are short, generally about 10 to about 20 seconds. Heretofore, coating compositions have in many instances failed to produce satisfactory results with respect to discoloration, corrosion resistance and/or adhesive properties when the coatings have been deposited at lower temperatures and with short process times. Known conversion coatings which usually contain Zr, Ti or Hf, and phosphate particularly have exhibited poor compatibility and poor adhesion characteristics with water-borne over-coatings.

In accordance with the present invention, a coating for aluminum and a method for its application have been discovered wherein the coating is rapidly formed on an aluminum surface providing excellent corrosion resistance to the aluminum and adherence to over-coatings. The coating is formed by subjecting aluminum to a treatment bath of the invention at pH values between 2.3 and 2.95, at temperatures generally between about 80° F. to about 120° F. and preferrably between about 90° F. and about 110° F. for coating times between 10 seconds and 60 seconds. Most frequently the bath is sprayed onto the aluminum. The pressure of the spray is a function of the number of nozzles and other characteristics of the production line.

The coating of the invention can be provided not only at lower temperatures and with short process times, but is compatible with both water- and solvent-borne over coating systems. The treatment bath or composition from which the coating is obtained is a solution which comprises zirconium, a fluoride source, a mixture of tannin, phosphate and zinc. A tannin to phosphate ratio of at least about 1, and preferably at least 1.5, must be maintained in the treating composition, and the zinc also must be present.

One advantage of the present invention is that the treatment bath is free of hexavalent chromium, ferricyanide, iron, cobalt, nickel, manganese, molybdenum and tungsten which can cause ecological problems and necessitate waste treatment of the resultant effluent. A further advantage of the present invention is that a zirconium-zirconium oxide coating can be deposited at a faster rate and lower temperature. Further, an optimum coating can be deposited on the surface of the aluminum so that corrosion resistance is achieved without sacrificing adhesion characteristics from either water- or solvent-borne over-coatings. Moreover, the treating bath that produces the coating is not as sensitive to "cleaning solution drag", the proclivity of a cleaning solution to undesirably alter the pH of the treating bath for the conversion coating. For example "drag-in" from an acidic cleaning solution used to clean cans of lubricants and fines in a can production line will lower the pH of a subsequent treating bath for a conversion coating, (like the one disclosed by Reghi in U.S. Pat. No. 4,338,140) below the commercially operable limits of the bath.

The coating of the present invention is applied to the aluminum surface in a treatment bath which contains zirconium ion, tannin, free and complex fluoride, phosphate and zinc ion. The preferable source of zirconium ions is fluozirconic acid, although other sources of zirconium ions such as alkali metal and ammonium fluozirconates, or zirconium fluoride, nitrates and carbonates, can be used effectively. The concentration of zirconium ion in the treatment bath ranges from about 10 ppm (0.010 g/l) to about 150 ppm (0.150 g/l) with the preferred concentration in the range from about 40 ppm (0.040 g/l) to about 80 ppm (0.080 g/l).

Fluoride ion sources are normally introduced into the treatment bath or composition in free and/or complex forms. These include hydrofluoric acid, fluoboric acid, alkali metal and ammonium fluorides. It is important that there is a sufficient amount of fluoride to complex both zirconium and zinc, and maintain the stability of the treatment composition. It is also extremely important that some additional fluoride be made available during a continuous coating process to complex dissolved aluminum from the metal surface, in order to avoid precipitation and maintain activity in the treatment composition. For this purpose, about three moles of fluoride for each mole of aluminum should be present. The concentration of fluoride ion for the treatment composition ranges from about 20 ppm (0.020 g/l) to about 250 ppm (0.250 g/l) with the preferred concentration in the range from about 50 ppm (0.050 g/l) to about 200 ppm (0.200 g/l).

The free fluoride concentration in the treatment bath is conveniently measured by a specific fluoride ion electrode in terms of millivolts (mv) which will vary depending upon the specific composition and concentration of the treatment composition constituents and the pH. For any particular treatment bath at a substantially constant pH, a correlation can be made between the millivolt reading and the free fluoride content. Such millivolt reading serves as a simple commercial control of the treatment bath. For example, a satisfactory treatment bath at a pH of about 2.7 is achieved by providing a free fluoride concentration to produce a millivolt reading of about −60 mv calibrated against a standard solution measured at 0 mv containing 20 ppm $F^-$ added as NaF adjusted to pH 1.3. The appropriate millivolt reading of the fluoride ion concentration can readily be ascertained in any treatment bath by simple experimentation.

Tannins, or vegetable tannins, are generally characterized as polyphenolic substances, as distinguished from mineral tannins which contain chromium, zirconium and the like. The tannins are generally characterized as polyphenolic substances which have molecular weights in the range of from about 400 to about 3000. The principal sources of such tannins are eucalyptus, hemlock, pine, larch and willow; woods such as quebracho, chestnut, oak and urunday; cutch and turkish; fruits such as myrobalans, valonia, dividivi, tera and algarrobilla; leaves such as sumac and gambier; and roots such as canaigre and palmetto. There are a wide variety of tannins commercially available including those from Mallinkrodt, Inc. For discussion of tannins, see *Encyclopedia of Chemical Technology,* 2nd Edition, Volume XII, Kirk-Othmer, pp. 303–341 (1967).

The concentration of the tannin in the treatment bath or composition is important. A high tannin concentration causes instability in an operating bath and reduces the corrosion resistance of the coating. However, tannin improves adhesion characteristics of the coating, especially in the presence of phosphates. Lowering the tannin concentration results in poor adherence with over coatings. Hence, in the presence of phosphates, a ratio of tannin to phosphate in the range of at least about 1/1 to about 2/1 must be maintained in the treatment bath to produce a coating which is corrosion resistant and exhibits adhesion qualities with both water-borne and solvent-borne organic over-coatings. Preferably the ratio of tannin to phosphate should be maintained at about 1.5/1. The deposition of tannin and phosphate on the surface of the can is controlled by a competing reaction between the two. The tannin concentration in the treatment bath ranges from about 30 ppm (0.030 g/l) to about 125 ppm (0.125 g/l) with the preferred concentration in the range of about 40 ppm (0.040 g/l) to about 80 ppm (0.080 g/l). The phosphate concentration in the presence of tannin also is important as hereinbefore described. By the addition of phosphate, a more corrosion-resistant coating can be obtained at a lower processing temperature. However, phosphate in the coating has a tendency to form a hydrophobic surface which causes incompatibility and poor adhesion with water-borne over-coatings. In accordance with the present invention, a balance of phosphate and tannin is established, to produce a corrosion-resistant coating at a lower temperature and at a lower treatment bath pH. The phosphate concentration in the treatment bath ranges from about 15 ppm (0.015 g/l) to about 100 ppm (0.100 g/l) with the preferred concentration in the range of about 25 ppm (0.025 g/l) to about 50 ppm (0.050 g/l).

Zinc ion is introduced into the treatment bath as zinc nitrate or other soluble zinc salt. While not being bound by any theory, it is believed that zinc ion assists, or activates, the process to help deposit, uniformly, more zirconium on the metal surface, which is necessary to provide boiling water corrosion resistance. The zinc ion concentration in the treatment bath ranges from about 5 ppm (0.005 g/l) to about 50 ppm (0.050 g/l) with the preferred ranges of about 10 ppm (0.010 g/l) to about 25 ppm (0.025 g/l).

The pH of the treatment bath is preferrably adjusted by the addition of nitric acid. Sulfuric or acetic acid may be added to maintain the acidity of the bath. A nitric acid concentration in the bath ranges from about 150 ppm (0.15 g/l) to about 500 ppm (0.5 g/l) with an acceptable pH in the range of about 2.3 to about 2.95, and preferrably in the pH range of about 2.5 to about 2.9.

A make-up concentrate is initially prepared for reasons of storage and shipping economy. The components of the concentrate may be dissolved in water in weight ratios corresponding to those desired in the treatment composition when the concentrate is diluted for use.

Generally, in the concentrate, the concentration ranges are: for zirconium ion from about 2 to about 10 grams/-liter; for fluoride ion from about 4 to about 30 grams/-liter; for tannin from about 3 to about 6 grams/liter; for phosphate from about 2.5 to about 12 grams/liter; and for zinc ion from about 1.0 to about 2.50 grams/liter.

In testing the quality of the coating of the invention, the coated aluminum resulting from treatment with the treatment bath was subjected to the following known and standard tests.

Simulated Pasteurization (Corrosion Resistance) Test

Because aluminum cans often are exposed to a pasteurization process, the cleaned and treated cans are subjected to a water-stain resistance test. The test is conducted by immersing a can bottom in a solution containing 0.082 g/l of sodium chloride, 0.220 g/l sodium bicarbonate and 2.18 g/l Du Bois 915 water conditioner. The test is conducted at 150° F.±5° F. for 30 minutes, after which time the cans are examined for staining. A cleaned-only can bottom blackens severely in a few minutes. After testing, the surface is rated as follows:

10: no blackening at all,
7–8: slight staining,
5: moderate staining,
0: severe blackening.

Muffle Furnace Test

A cleaned and treated can is exposed in a muffle furnace at 900° F. to 1000° F. for about 4 to 5 minutes. The presence of coating is indicated by a light yellow to golden discoloration, depending on the amount of coating.

Tape Adhesion Test

This test is a measure of the adhesion between a treated surface and an organic finish or overcoating. The finished surface after being cured, is immersed in boiling tap water or 1% detergent (such as "Joy", a Procter & Gamble product) solution for 15 minutes, rinsed in tap water, and dried. The surface is then cross-hatched, and Scotch-brand transparent tape (#610) is applied to the cross-hatched area. The amount of paint removed by the tape is observed. Results are rated as:

10: excellent adhesion,
8–9: very slight removal,
0: total removal of coating.

The following examples typify how the invention may be practiced. The examples should be construed as illustrative, and not as a limitation upon the overall scope of the invention.

Concentrate A

A make-up concentrate of a treatment bath of the invention was prepared by mixing the following ingredients in the indicated amounts:

| Ingredients | Amount (grams/liter) |
|---|---|
| water | 951.90 |
| fluozirconic acid, 45% | 10.00 |
| fluoboric acid, 48% | 3.50 |
| zinc nitrate,.4$H_2O$ | 5.00 |
| tannic acid, U.S.P. | 5.00 |
| phosphoric acid, 75% | 3.60 |
| nitric acid, 42° Be | 15.00 |
| *Tris-nitro, 50% liquid | 1.5 |
| **Hampex 80 | 3.0 |
| Propylene glycol | 1.5 |

*Tris-nitro, 50% liquid is a bacteriacide which is a 50% solution of tris (hydroxymethyl) nitromethane and is a trade name of IMC Chemical Group, Inc.

**Hampex 80 is a water conditioner which is a 40% solution of, pentasodium diethylenetriamine pentaacetate and is a trade name of W. R. Grace Co. Both the Hampex 80 and propylene glycol chelate metal ions including calcium and magnesium present in hard water for optimal operation of the treatment bath. Unless otherwise chelated, these ions would interfere with the ability of the treating bath to produce a commercially satisfactory conversion coating on the aluminum. The bacteriacide and the water conditions are not critical to the invention.

EXAMPLE I

A treatment bath was obtained by preparing a 1.5% by volume aqueous solution of concentrate A at a pH of about 2.7. Drawn and ironed aluminum cans were cleaned with a sulfuric acid cleaner, using a spray washer, followed by a cold tap-water rinse to provide a water-breakfree surface. The cleaned cans then were subjected to treatment in the bath at about 100° F. for 15 seconds, and spray washed with 5 to 7 psi spray pressure. The cans then were rinsed in tap water, followed by a deionized water rinse, and oven drying at 350° F. for 3.5 minutes. The following tests were performed with the treated cans:

A. TR-4 Pasteurization Test
B. Muffle Furnace Test
C. Coating Adhesion Test
D. Surface Analysis by Ion Microprobe Technique In the tests the cans treated pursuant to the invention were compared to cleaned-only cans; cans treated in a bath with the ingredients of Example I, but without zinc and phosphate; and cans treated with the composition and under the process described in Example 11 of U.S. Pat. No. 4,148,670 to Kelly.

TABLE 1

| | TR-4 and Muffle Tests | |
|---|---|---|
| Substrate | TR-4 | Muffle Test |
| 1. Cleaned-only cans | 0 | grayish |
| 2. Cleaned and treated cans, using Example I at 100° F. | 10 | golden |
| 3. Cleaned and treated cans, using Example I, without zinc and phosphate, at 100° F. | 7–8 | very light yellow |
| 4. Cleaned and treated, using example 11, of Kelly Patent, 4,148,670 at 100° F. | 10 | dark gold |

Coating Adhesion Study

For coating adhesion evaluation, polyester Coke Red ink from Acme was applied by a rubber brayer. Water-borne wet ink varnish, designated as 720 H332 from De Soto Company was roll-coated by a #10 draw-down bar to achieve coating thickness of 2.5 mg/in$^2$. The coated surface then was cured in a forced-air oven for 90 seconds at 350° F. Adhesion tests were conducted after subjecting the coated can panels to either boiling tap water or 1% Joy solution for 15 minutes, and by applying Scotch tape. The results were as follows:

TABLE 2

| | Adhesion Test Results | |
|---|---|---|
| Substrate | Boiling Water | 1% Joy Solution |
| 1. Cleaned only surface | 10 | 8 |

TABLE 2-continued

| Substrate | Adhesion Test Results: Boiling Water | 1% Joy Solution |
|---|---|---|
| 2. Cleaned and treated, using Example I | 10 | 10 |
| 3. Cleaned and treated, using Example I without zinc and phosphate, 100° F. | 10 | 10 |
| 4. Cleaned and treated, using Example 11 of Kelly patent 4,148,670, at 100° F. | 0 | 0 |

Surface Analysis Data Using Ion Probe Technique

The surface analysis of the above substrate was conducted by Ion Microprobe Analysis to determine the elemental concentration and distribution on the aluminum surface. It is known that a certain minimum concentration of zirconium-zirconium oxide of about 10 atomic percent must be maintained on the surface to achieve desired TR-4 corrosion resistance. In respect to this invention, it has been found that it is very important that an optimum ratio of tannin to phosphate of at least about 1:1 must be deposited on the surface of the aluminum to obtain adhesion with an organic over coating. Ion Microprobe method of surface analysis can be utilized effectively to determine elemental composition on the surface.

In the Ion Microprobe technique, aluminum samples were cut out to approximately ¼ inch in size and mounted on an aluminum plate. The system was then evacuated to a high vacuum and the samples analyzed, using a positive primary argon beam to sputter away the surface. The following samples were subjected to the Ion Microprobe Analysis:

Sample 1: cleaned-only surface

Sample 2: cleaned and treated, using Example I

Sample 3: cleaned and treated, using Example I without zinc and phosphate, 100° F., with replenished bath Sample 4: cleaned and treated, using Example 11 of Kelly U.S. Pat. No. 4,148,670

Sample 5: cleaned and treated using a replenished bath from make-up using Example I, containing 50 ppm phosphate and 30 ppm tannin in the bath.

During the sputtering process, secondary ions generated from the surface were analyzed by mass spectrometer. All intensities for various elements on the surface were recorded in the computer memory. The mass spectra for each sample analysis was produced. A quantitative analysis program was run to determine atomic percentages of various elements and functional groups on the surface. The results are tabulated as follows in Table 3.

TABLE 3

ION MICROPROBE SURFACE ANALYSIS DATA

| Surface Elements | Mass Number | Atomic Percent: Sample 1 | Sample 2 | Sample 3 | Sample 4 | Sample 5 |
|---|---|---|---|---|---|---|
| $CH_2$ | 14 | 0.89 | 6.75 | 3.70 | 5.04 | 5.44 |
| $CH_3$ | 15 | 1.55 | 7.13 | 7.52 | 6.86 | 5.41 |
| F | 19 | 1.49 | 8.69 | 35.18 | 33.85 | 11.46 |
| Mg | 24 | 0.33 | 2.11 | 0.78 | 0.93 | 1.55 |
| Al | 27 | 95.67 | 50.01 | 41.91 | 15.37 | 39.53 |
| *P | 31 | 0.01 | 4.94 | 0.16 | 12.69 | 10.12 |
| Ca | 40 | 0.04 | 5.00 | 0.24 | 6.67 | 3.98 |
| Zn | 64 | 0.01 | 1.67 | 0.59 | 1.90 | 1.30 |
| Zr | 90 | 0.00 | 9.07 | 6.42 | 10.30 | 14.7 |

TABLE 3-continued

ION MICROPROBE SURFACE ANALYSIS DATA

| Surface Elements | Mass Number | Atomic Percent: Sample 1 | Sample 2 | Sample 3 | Sample 4 | Sample 5 |
|---|---|---|---|---|---|---|
| ZrO | 106 | 0.00 | 4.65 | 3.50 | 6.35 | 7.03 |

*from phosphate

Data Analysis, Ion Microprobe Studies

It is important that approximately 10 atomic percent of zirconium-zirconium oxide be present to obtain TR-4 corrosion resistance.

In Samples 2 and 3, the presence of tannin, as characterized by —$CH_2$ and —$CH_3$ functional groups, was 13.8 and 11.2 atomic percent respectively. The amount of tannin on the surface plays an important role with regard to the adhesion characteristics of the organic over-coatings, especially water-borne organic over-coatings.

Sample 2 surface was prepared from a tannin/phosphate solution with zirconium. Zirconium-zirconium oxide concentration is about 13 atomic percent, producing excellent TR-4 corrosion resistance. The tannin to phosphate ratio on the surface is about 13:5. This surface will provide excellent adhesion with water-borne over-coatings.

Sample 3 surface does not contain phosphate, and therefore corrosion resistance and adhesion are dependent on zirconium and tannin concentration on the surface.

Sample 4 surface contained about 16 atomic percent zirconium-zirconium oxide, and also provides excellent TR-4 corrosion resistance. The surface contains —$CH_2$, —$CH_3$ organics, about 12 atomic percent, the source of which may be gluconates used in the formulation, but not from tannin. The surface also contains 12 atomic percent phosphorus. The surface exhibited total failure of adhesion with water-borne organic over varnish.

Tannin To Phosphate Ratio

Experiments were conducted with various proportions of tannin and phosphate in the bath. Aluminum cans were treated with various combinations, and adhesion tests conducted after painting the cans with Acme ink and De Soto water-borne over varnish.

It was found that it is important that a balance of tannin and phosphate be maintained in the treatment composition in order to deposit the necessary ratio of tannin and phosphate on the aluminum surface to yield desired adhesion and corrosion resistance.

| Ingredients | Concentrate B Replenisher: Amount (grams/liter) |
|---|---|
| water | 882.00 |
| nitric acid, 42° Be | 32.50 |
| fluozirconic acid, 45% | 45.00 |
| hydrofluoric acid, 70% | 13.00 |
| zinc nitrate, $4H_2O$ | 5.00 |
| tannic acid, U.S.P. | 3.50 |
| phosphoric acid, 75% | 10.00 |
| Tris-nitro, 50% | 4.00 |
| Hampex 80 | 4.00 |
| Propylene glycol | 4.00 |

Tests were made on sample cans using a bath replenished with concentrate "B", varying the tannin to phosphate ratio. The cans were treated by spraying the various baths having varying tannin to phosphate ratios at a pH of 2.7 for 15 seconds at 5 to 7 psi. The cans were subjected to the Boiling Water Adhesion Test, the Joy Adhesion Test and the TR-4 Resistance Test with the results shown in Table 4.

TABLE 4

| Replenished Treatment bath from make-up using Example I | | Boiling | Joy | |
|---|---|---|---|---|
| Tannin Concentration | Phosphate Concentration | Water Adhesion | Ad-hesion | TR-4 Resistance |
| 1. 30 ppm | 50 ppm | 0 | 2 | 10 |
| 2. 50 ppm | 50 ppm | 9 | 10 | 10 |
| 3. 70 ppm | 50 ppm | 10 | 9 | 10 |
| 4. 90 ppm | 50 ppm | 10 | 10 | 10 |

Based on the results in Table 4 the tannin-phosphate concentration in the bath should be maintained at least at about 1:1 and preferably at about 1.5 parts tannin to 1 part phosphate. Also, the phosphate concentration in the bath should be limited to 30 to 50 ppm.

Further studies were done to develop a replenisher and to study the replenisher under various operating conditions.

A treatment bath was prepared using concentrate "A", which then was aged with cleaned aluminum cans and simultaneously replenished with concentrate "B", to maintain specific processing conditions. Cans were treated and then subjected to TR-4 blackening resistance and exterior adhesion tests with ink and water-borne over varnish.

Surface analysis of the cans also was conducted, using the Ion Microprobe technique to determine the zirconium concentration on the surface. Further, a correlation was made as to the ratio of tannin to phosphate, and adhesion characteristics of a water-borne over varnish.

A reference sample of a cleaned-only can was studied. The Ion MicroProbe surface analysis of a cleaned-only can surface is shown in Table 5. It must be noted that carbon ($CH_2$, $CH_3$) present on the reference sample is about 8.2 atomic percent. This background should be subtracted from the amount obtained in the treated sample, to determine the amount of carbon ($CH_2$, $CH_3$) contributed by tannin from the treatment bath.

TABLE 5

| Element | Mass | Atomic % |
|---|---|---|
| $CH_2$ (organic) | 14 | 5.91184 |
| $CH_3$ (organic) | 15 | 2.28900 |
| F | 19 | 2.58056 |
| Mg | 24 | 1.42857 |
| Al | 27 | 87.57716 |
| P | 31 | 0.03962 |
| Ca | 40 | 0.17404 |
| Zn | 64 | 0.00000 |
| Zr | 90 | 0.00000 |
| ZrO | 106 | 0.00000 |
| SUM | | 100.00000 |

EXAMPLE II

A treatment bath was prepared at 1.5% by volume of concentrate A. Cleaned cans then were subjected to treatment in the bath at about 100° F. for 15 seconds. The cans were then rinsed in tap water, followed by a deionized water rinse and oven drying at 350° F. for 3.5 minutes.

Treatment bath conditions were as follows:

pH 2.70
fluoride-60 mv (approx. 50–60 ppm)
phosphate ($PO_4$) 24 ppm
tannin 50 ppm The cans then were subjected to a TR-4 Resistance Test and a Adhesion Test. The results of the TR-4 Resistance Test were excellent as the cans showed no blackening.

In the Adhesion Test, Coke Red ink and DeSoto water-borne (720 H332) over varnish was cured for 90 seconds at 350° F. The results of the Adhesion Test were excellent as the cans showed no peeling.

An Ion Microprobe analysis of the coated cans yielded the results shown in Table 6.

TABLE 6

| Element | Mass | Atomic % |
|---|---|---|
| $CH_2$ (organic) | 14 | 22.21866 |
| $CH_3$ (organic) | 15 | 9.92289 |
| F | 19 | 3.29329 |
| Mg | 24 | 1.19905 |
| Al | 27 | 27.27937 |
| P | 31 | 5.60257 |
| Ca | 40 | 7.60216 |
| Zn | 64 | 1.13872 |
| Zr | 90 | 16.01765 |
| ZrO | 106 | 5.72614 |
| SUM | | 100.00000 |

From the Ion Microprobe analysis the TR-4 test and the Adhesion Test the following conclusions can be made.

The tannin concentration ($CH_2$, $CH_3$) was 32.13–8.2 (background), or 23.9 atomic percent of the coating. The phosphate concentration (P) was 5.60 atomic percent. The tannin to phosphate ratio was 4.27:1

Excellent adhesion was achieved due to high tannin to phosphate ratio on the surface. Excellent TR-4 blackening resistance was due to the presence of an appropriate amount of zirconium-zirconium oxide on the surface.

EXAMPLE III

A treatment bath was prepared by diluting the Concentrate A with water to 1.5% by volume. The bath was then aged with several aluminum cans and simultaneously replenished, using a replenisher concentrate, to adjust the pH between 2.5 and 2.9. Aging of the bath was continued until the bath was turned over a few times with replenisher.

Cleaned cans then were subjected to the replenished baths 3A to 3D having varying conditions shown below at 100° F. for 15 seconds in a laboratory spray washer at 5 to 7 psi. After tap water rinsing, the cans were rinsed in deionized water and dried in the oven at 350° F. for 3.5 minutes. The cans were then subjected to TR-4 blackening test, coating adhesion test, and surface analysis by Ion Microprobe.

Replenished Bath 3A

For replenished bath 3A, the conditions were:
pH 2.50
fluoride −63mv (approx. 160 ppm)
phosphate ($PO_4$) 42 ppm
tannin 70 ppm The results of the TR-4 Resistance Test were excellent as the cans showed no blackening. The results of the Adhesion Test were excellent as the cans showed no peeling.

An Ion Microprobe analysis of the cans coated with bath 3A yielded the results shown in Table 7.

TABLE 7

| Element | Mass | Atomic % |
|---|---|---|
| $CH_2$ | 14 | 16.73402 |
| $CH_3$ | 15 | 9.53457 |
| F | 19 | 10.46069 |
| Mg | 24 | 0.60871 |
| Al | 27 | 16.48328 |
| P | 31 | 10.73698 |
| Ca | 40 | 3.25928 |
| Zn | 64 | 1.16885 |
| Zr | 90 | 21.62416 |
| ZrO | 106 | 9.38948 |
| SUM | | 100.00000 |

The tannin concentration ($CH_2$, $CH_3$) was 26.26–8.2 (background) or 18.06 atomic percent of the coating. The phosphate concentration (P) was 10.74 atomic percent. The tannin to phosphate ratio was 1.68:1. The results indicate that excellent adhesion is achieved at this tannin to phosphate ratio.

Replenished Bath 3B

For replenished bath 3B the conditions were:
pH 2.55
fluoride −65.7 mv (approx. 175 ppm)
phosphate 31 ppm
tannin 75 ppm The results of the TR-4 Resistance Test were excellent as the cans showed no blackening. The results of the Adhesion Test were excellent as the cans showed no peeling.

An Ion Microprobe analysis of the cans coated with bath 3B yielded the results shown in Table 8.

TABLE 8

| Element | Mass | Atomic % |
|---|---|---|
| $CH_2$ | 14 | 14.83608 |
| $CH_3$ | 15 | 17.11333 |
| F | 19 | 15.74237 |
| Mg | 24 | 1.02184 |
| Al | 27 | 15.14408 |
| P | 31 | 7.20333 |
| Ca | 40 | 4.37674 |
| Zn | 64 | 1.83659 |
| Zr | 90 | 14.82411 |
| ZrO | 106 | 7.90151 |
| SUM | | 100.00000 |

The tannin concentration ($CH_2$, $CH_3$) was 31.99–8.2 (background) or 23.79 atomic percent of the coating. The phosphate concentration (P) was 7.20 atomic percent. The tannin to phosphate ratio was 23.79:7.20 or 3.3:1. This ratio is high enough to provide excellent adhesion. Further, excellent blackening resistance was also achieved, due to the presence of appropriate amounts of zirconium-zirconium oxide (22.72 atomic percent) in the coating.

Replenished Bath 3C

For replenished bath 3C, the conditions were:
pH 2.85
fluoride −59.6 mv (approx. 150 ppm)
phosphate 16 ppm
tannin 70 ppm The TR-4 Resistance Test showed light staining on the dome of the cans. The results of the Adhesion Tests were excellent as the cans showed no peeling.

An Ion Microprobe analysis of the cans coated with bath 3C yielded the results shown in Table 9.

TABLE 9

| Element | Mass | Atomic % |
|---|---|---|
| $CH_2$ | 14 | 9.45642 |
| $CH_3$ | 15 | 13.76714 |
| F | 19 | 16.20717 |
| Mg | 24 | 0.44742 |
| Al | 27 | 47.66534 |
| P | 31 | 1.97973 |
| Ca | 40 | 1.23110 |
| Zn | 64 | 1.00040 |
| Zr | 90 | 5.53710 |
| ZrO | 106 | 2.70820 |
| SUM | | 100.00000 |

The tannin concentration ($CH_2$, $CH_3$) was 23.21–8.2 (background) or 15.01 atomic percent. The phosphate concentration (P) was 1.98 atomic percent. The tannin to phosphate ratio was 15.01:1.98 or 7.58:1. The high tannin to phosphate ratio again indicated that it would provide excellent adhesion, as shown above. The coating contained a lower concentration of zirconium-zirconium oxide (8.24 atomic percent) and therefore exhibited slight staining.

In view of the above, to achieve good adhesion characteristics with water-borne over-coatings, the tannin to phosphate ratio must be maintained at least about 1:1, and preferably about 1.5:1. To obtain good TR-4 blackening resistance, the zirconium-zirconium oxide concentration in the coating should be on the order of 10 to 20 atomic percent.

The invention in its broader aspects is not limited to the specific details shown and described, but departures may be made from such details within the scope of the accompanying claims without departing from the principles of the invention and without sacrificing its advantages.

What is claimed is:

1. A non-chromate coating solution effective in forming a coating on aluminum comprising: from about 10 to about 150 ppm zirconium, from about 20 to about 250 ppm fluoride, from about 30 to about 125 ppm tannin, from about 15 to about 100 ppm phosphate and from about 5 to about 50 ppm zinc, said coating solution having a tannin to phosphate ratio in the range of at least about 1:1 to about 2:1 and a pH in the range of about 2.3 to about 2.95.

2. A non-chromate coating solution as recited in claim 1 wherein said coating solution is effective in forming a coating to impart corrosion resistance to an aluminum surface, said coating solution comprising from about 40 to about 80 ppm zirconium, from about 50 to about 200 ppm fluoride, from about 40 to about 80 ppm tannin, from about 25 ppm to about 50 ppm phosphate and from about ppm to about 25 ppm zinc.

3. A non-chromate coating solution as recited in claim 2 wherein said coating solution has a pH in the range of about 2.5 to about 2.9.

4. A non-chromate coating solution as recited in claim 2 wherein said coating has a tannin to phosphate ratio of about 1.5:1.

5. A non-chromate coating solution as recited in claim 4 wherein said coating solution has a pH in the range of about 2.5 to about 2.9.

6. A non-chromate process for forming a corrosion resistant paint receptive coating on an aluminum surface comprising contacting the aluminum surface with a treatment composition having a pH from about 2.3 to about 2.95, said treatment composition comprising from about 10 ppm to about 150 ppm zirconium, from about 20 ppm to about 250 ppm fluoride, from about 30 ppm to about 125 ppm tannin, from about 15 ppm to about 100 ppm phosphate and from about 5 ppm to about 50 ppm zinc, said composition having a tannin to phosphate ratio in the range of about 1:1 to about 2:1.

7. A process as recited in claim 6 wherein said treatment is at a temperature in thee range of about 80° F. to about 120° F.

8. A process as recited in claim 6 wherein said treatment composition is at a temperature in the range of about 90° F. to about 110° F.

9. A process as recited in claim 8 wherein contacting the aluminum surface with said treatment composition comprises spraying said treatment composition onto the aluminum surface for about 10 seconds to about 60 seconds.

10. A process as recited in claim 6 wherein said treatment composition comprises from about 40 ppm to about 80 ppm zirconium, from about 50 ppm to about 200 ppm fluoride, from about 40 ppm to about 80 ppm tannin, from about 25 ppm to about 50 ppm phosphate and from about 10 ppm to about 25 ppm zinc.

11. A process as recited in claim 10 wherein said treatment composition has a pH in the range of about 2.5 to about 2.9.

12. A process as recited in claim 10 wherein said treatment composition has a tannin to phosphate ratio of about 1.5:1.

13. A process as recited in claim 12 wherein said treatment composition has a pH in the range of about 2.5 to about 2.9.

14. A process as recited in claim 13 wherein said treatment composition is at a temperature in the range of about 90° F. to about 110° F.

15. A process as recited in claim 14 wherein contacting the aluminum surface with said treatment composition comprises spraying the aluminum surface with said treatment composition for about 10 to about 60 seconds.

* * * * *